United States Patent [19]

v Engelenburg et al.

[11] Patent Number: 4,566,744

[45] Date of Patent: Jan. 28, 1986

[54] CURRENT COLLECTOR FOR ROTATING SHAFT

[75] Inventors: Hendrik v Engelenburg, Driebergen, Netherlands; Rugerus S. Heemskerk, Pfandhausen, Fed. Rep. of Germany

[73] Assignee: SKF Industrial Trading & Development Company B.V., Nieuwegein, Netherlands

[21] Appl. No.: 508,611

[22] Filed: Jun. 28, 1983

[51] Int. Cl.[4] ..... H01R 39/00

[52] U.S. Cl. ..... 339/8 L; 310/178; 310/219; 339/118 RY

[58] Field of Search ..... 310/90, 178, 219, 221, 310/71; 339/5 R, 5 L, 8 R, 8 L, 118 RY

[56] References Cited

U.S. PATENT DOCUMENTS

| | | | |
|---|---|---|---|
| 3,021,496 | 2/1962 | Kenyon | 339/118 RY |
| 3,034,082 | 5/1962 | Rayon | 339/8 L |
| 3,127,230 | 3/1964 | Marquis et al. | 339/8 L |
| 3,431,532 | 8/1966 | Cary | 310/178 |
| 3,483,307 | 12/1969 | Goodman, Jr. | 339/5 R |
| 4,171,496 | 10/1979 | Eriksson | 310/219 |

FOREIGN PATENT DOCUMENTS

| | | | |
|---|---|---|---|
| 2325398 | 12/1973 | Fed. Rep. of Germany | 310/219 |

*Primary Examiner*—Peter S. Wong
*Assistant Examiner*—D. L. Rebsch
*Attorney, Agent, or Firm*—Yuter, Rosen & Dainow

[57] ABSTRACT

A current collector having a housing which has a rotatably supported electrical contact shaft having a projecting end that is engageable with a rotating drive shaft, the housing including a mercury contact formed by a space containing mercury, one end of the contact shaft being moveable into the space for contact with the mercury, and a sealing cover for the space.

20 Claims, 2 Drawing Figures

CURRENT COLLECTOR FOR ROTATING SHAFT

The invention relates to a current collector, provided with a housing, wherein is rotatably supported an electrical contact shaft which, by an end projecting from the housing, may be brought into contact with a rotating shaft, in order to be brought into rotation and likewise make electrical contact therewith, where mercury is contained in the housing in order to bring about electrical connection between the contact shaft and a contact member attached in the housing.

Such a current collector may be used to collect the electric current from a rotating shaft, the bearing of which is connected to a "lube-check" measuring device, by which the properties of flow of electric current through the bearing during rotation of the shaft are determined, these properties supplying an indication for the state of lubrication of the bearing, so that an idea of the state of wear of the bearing is thereby obtained.

Known is a current collector, the interior of the housing of which is completely filled with mercury which surrounds the centermost portion of a contact shaft projecting from the housing at either end. Disadvantageous here is not only the relatively great quantity of mercury which must be used in order to fill the housing, but also the sealing provisions in passage of the contact shaft from the housing. In addition, manufacture of the known current collector is costly.

The object of the invention is to procure a current collector wherein less mercury is required and which may be manufactured much more cheaply.

To this end the current collector pursuant to the invention is characterized in that the housing is closed off at one end by a sealing cover, while the end of the contact shaft lies facing the sealing cover, the sealing cover and the facing contact-shaft end being provided with cooperating members formed concentric with the axis of rotation of the contact shaft and sliding sealingly telescopically on one another, between which is formed a closed space wherein the mercury is contained.

Here the dimensions of the chamber to be filled with mercury may easily be made so small that one drop of mercury of, for example, 0.632 gram is already sufficient to obtain proper operation of the current collector. In addition, the mercury chamber need be sealed off only at one end.

In particular, the current collector pursuant to the invention may be designed such that these members comprise a blind hole, formed in one of the two aforesaid facing components, and a sealing plug, formed on the other component and extending partially into the blind hole in order to close it off.

In an advantageous design thereof the blind hole may be formed in the end of the contact shaft and the sealing plug on the sealing cover, so that the rotating contact shaft brings the mercury into rotation, so that the mercury, when the quantity thereof does not fill the entire space of the sealed hole by centrifugal force, nevertheless forms a contact mass uniformly distributed over the circumference of the hole.

In the latter case the innermost portion of the blind hole itself may be designed with a diameter greater than the sealing plug and have an annular shoulder, the sealing plug carrying a bent contact spring, the free end of which projects into the mercury in the annular space between the annular shoulder and the floor of the blind hole. In this connection, care is taken to see that the quantity of mercury is no greater than the volume of the annular space between the annular container and the floor of the hole. In rotation the mercury will then form an annular contact mass which is retained in axial direction by the annular shoulder.

In each case the current collector pursuant to the invention may be designed such that the sealing plug in the blind hole forms a split seal for the mercury in order to prevent leakage of mercury.

In addition, the current collector pursuant to the invention may be designed such that the centermost portion of the contact shaft is received in two angular contact bearings, the inner races of which are confined between a flange formed on the contact shaft and a retaining nut screwed on the contact shaft, and the outer races of which fit on the cylindrical inner surface of the housing and are confined between a shoulder formed on the housing and the sealing cover attached to the housing by means of a retaining ring.

The contact shaft and the sealing cover are thereby fixed in axial direction in the housing relatively to each other.

In addition, the retaining ring may then carry an internal dividing wall which is provided with a central aperture through which the contact shaft extends, while all around the aperture, on the dividing wall, is attached a rubber V-seal which seals off the end of the contact shaft projecting through the aperture, thus providing extra protection against the leakage of mercury from the housing to the outside.

The invention will be described below with the aid of the drawing, wherein two examples of the current collector pursuant to the invention are shown.

Figure 1:
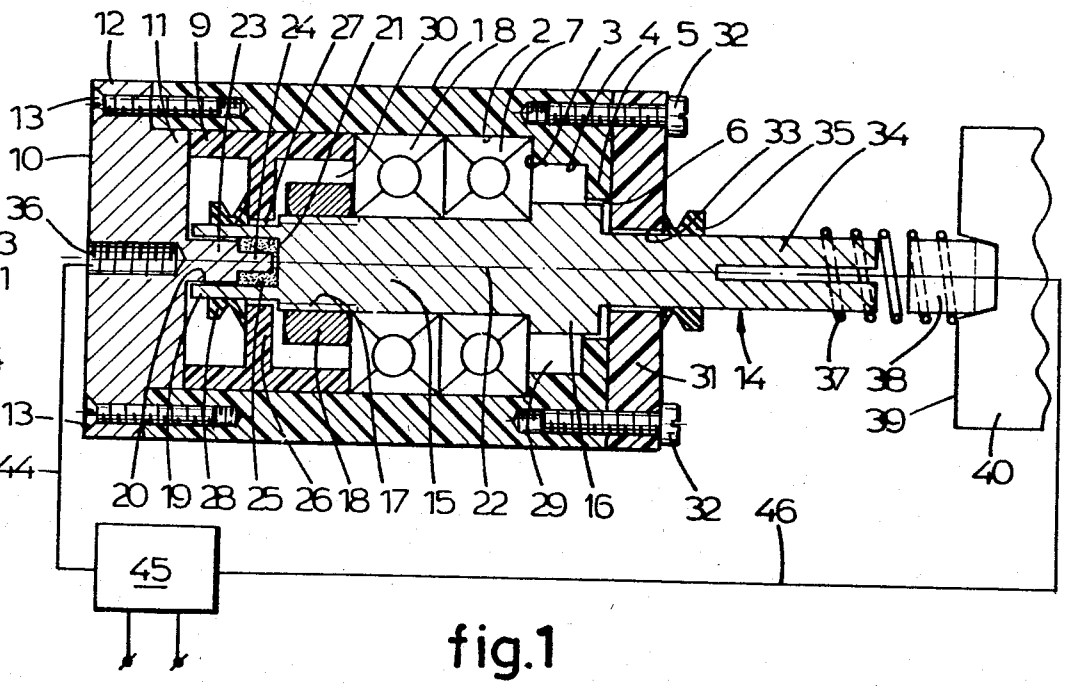
FIG. 1 is an axial cross section of a first embodiment of the current collector pursuant to the invention, which is here depicted at twice actual size.

As shown in FIG. 1, the current collector has a housing 1 having a cylindrical shell with a cylindrical inner surface 2 which at the right terminates in a shoulder 3, to which is joined a cylindrical inner surface 4 of reduced diameter which terminates at a flange 5 facing inward and surrounding an aperture 6. The outer races of two angular contact bearings 7,8 are conveniently accomodated on the cylindrical inner surface 2 in the housing 1. The outer race of the right-hand bearing 7 rests against the shoulder 3, while the left-hand bearing 8 rests against the right-hand bearing 7. A retaining ring 9 is conveniently accomodated on the cylindrical inner surface 2 in the housing 1 and rests against the outer race of the left-hand bearing 8. The left-hand side the housing 1 is completely closed by a sealing cover 10 having a cylindrical portion 11 which fits on the cylindrical inner surface 2, as well as a flange 12 which rests against the left-hand side of the housing 1 and is attached thereto by means of screws 13, two of which are shown in FIG. 1.

The cylindrical cover part 11 rests against the retaining ring 9, so that the bearings 7,8 are fixed in axial direction in the housing 1. In the bearings 7,8 the part 15 of a contact shaft 14 is conveniently accomodated in the inner races of the bearings 7,8. To the right of the part 15, the contact shaft 14 has a flange 16, which rests against the inner race of the bearing 7. To the left of the part 15, the shaft has a part with screw thread 17, on which a retaining nut 18 is screwed against the inner race of the bearing 8 and then secured with Loctite.

The contact shaft 14 is therefore capable of rotation about the rotary shaft 22, which coincides with the centerline of the cylindrical inner surface 2, but the contact shaft 14 is fixed axially undisplaceable in regard to the housing 1 and the sealing cover 10.

To the left of the screw-thread part 17, the contact shaft 12 has a terminal part 19, designed with a smaller diameter, wherein is formed a cylindrical blind hole 10 which is coaxial with the rotary shaft 22 and terminates in the floor 21. At the inner side of the sealing cover 10 is formed a cylindrical sealing plug 23, which is coaxial with the hole 20 and is partly inserted therein and seals it off. At its inner end the sealing plug, pursuant to FIG. 1, carries a cylindrical contact pin 24, designed with reduced diameter, which is coaxial with the sealing plug 23 and terminates at a short distance from the floor 21 of the hole 20.

The space of the hole 20 between the sealing plug 23 with the contact pin 24 and the floor 21 is filled with mercury 25, which serves to bring about an electrical connection between the contact shaft 14 and the contact pin 24, in particular during rotation of the contact shaft 14. The dimensions of the hole 20 and the contact pin 24 are such that a drop of mercury of only 0.632 gram is sufficient to at least nearly fill this space. In this connection, it is not even necessary that the mercury 25 fill this space completely, because during rotation of the contact shaft 14 the mercury 25 is in rotation and, under the influence of centrifugal force, forms a cohesive contact mass which spreads uniformly over the circumference of the cylindrical wall of the hole 20 and that of the contact pin 24 to ensure electrical contact between them. To prevent leakage of the mercury 25 the difference between the diameter of the cylindrical wall of the hole 20 and that of the sealing plug 23 is so small that the plug 23 forms a split seal for the mercury 25 in the hole 20.

The retaining ring 9 bears an internal dividing wall 26, with aperture 27 having a diameter greater than the outer diameter of the terminal part 19 of the contact shaft 14 extending through it. About the aperture 27 is mounted, on the dividing wall 26, a V-shaped rubber sealing ring 28 which seals off the end 19 of the contact shaft 14.

The chamber 29 to the left of the flange 5 and the chamber 30 to the right of the dividing wall 26 are filled with grease for lubricating the bearings 7,8.

At the right-hand side, the housing 1 is closed off by a cover 31 which is attached to the housing 1 with a plurality of screws 32, two of which are visible in FIG. 1. The cover 31 has an aperture 33, through which the right-hand end 34 of the contact shaft 14 projects with clearance. To the cover 31 is attached a V-shaped rubber seal 35, which seals off the projecting part 34 of the contact shaft 14.

The housing 1 is made of an electrically non-conducting material, namely delrin (a type of synthetic material). The contact shaft 14 and the sealing cover 10 on the left are made of metal. The retaining ring 9 is made of an electrically non-conducting synthetic material.

In the sealing cover 10 on the left is formed a blind screw-thread bore 36 for connection of an electrical conductor 44, by which the current collector may be connected with a "lube check" measuring device 45, i.e. a device which serves, during the rotation of a shaft 40, with the aid of the flow of electric current through the shaft bearing (not shown), to provide an indication of the state of lubrication thereof. For this purpose, the measuring device is on the other hand connected via the conductor 46 with the outer race of the shaft bearing, while the current is collected from the shaft 40 by the current collector, in that the projecting contact-shaft part 34 thereof, if necessary with the aid of a spiral spring 37 having a connecting pin 38 (both electrically conducting) is held pressed against the center of the end surface 39 of the rotating shaft 40, so that the contact shaft 14 rotates at the same speed as the shaft 40.

The current flow then takes place from the shaft 40 via the connecting pin 38 and the spiral spring 37 on the contact shaft 14 rotating along with it and from there via the mercury 25 on the stationary contact pin 24 and the left-hand sealing cover 10 and the conductor 44 screwed into the bore 36 to the "lube check" gage 45.

Figure 2:
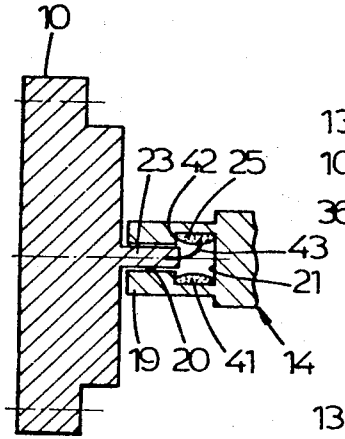
FIG. 2 is an axial cross section of the part modified as regards FIG. 1 of a second embodiment of the current collector pursuant to the invention.

In the modified embodiment pursuant to FIG. 2 the innermost part 41 of the hole 20 is designed with a greater diameter, so that an annular shoulder 42 is formed. Instead of the contact pin 24 of FIG. 1 the sealing plug 23 here carries a bent contact spring 43, the free outer end of which projects into the annular space between the annular shoulder 42 and the expanded floor 21.

In rotation of the contact shift 14, the mercury 25, by centrifugal force, assumes the annular shape depicted in FIG. 2, while the free outer end of the contact spring 43 projects into the annular mass of mercury 25 in order to bring about electrical connection between the contact shaft 14 and the sealing cover 10. At the same time the quantity of mercury 25 has a smaller volume than the annular space between the annular shoulder 42 and the floor 21. In this case the annular shoulder 42 retains the annular mass of mercury 25 is axial direction during rotation of the contact shaft 14.

We claim:

1. In a current collector, provided with a housing, wherein is rotatably supported an electrical contact shaft which, by an end projecting from one end of the housing, may be brought into contact with an independently rotating shaft in order thereby to be brought into rotation and likewise make electrical contact therewith, where mercury is contained in the housing in order to bring about electrical connection between the contact shaft and a contact member attached in the housing, the improvement wherein the housing is closed off at its other end by a removable sealing cover, the contact shaft having a terminal part which faces the sealing cover, the terminal part having a cylindrical blind hole which is coaxial with the contact shaft, means fixedly provided on said cover for sealing the hole and forming a closed space for the mercury when said cover is fastened to said housing, said closed space being subject to addition and removal of said mercury upon separation of said sealing cover from said housing.

2. Current collector according to claim 1, wherein the cover has an inner side, and the sealing means comprises a sealing plug formed on the inner cover side which is coaxial with the hole, the sealing plug carrying a cylindrical and coaxial contact pin of reduced diameter and being slidably received in the hole.

3. In a current collector, provided with a housing, wherein is rotatably supported an electrical contact shaft which, by an end projecting from one end of the housing, may be brought into contact with an independently rotating shaft in order thereby to be brought into rotation and likewise make electrical contact therewith, where mercury is contained in the housing in order to bring about electrical connection between the contact shaft and a contact member attached in the housing, the improvement wherein the housing is closed off at its other end by a sealing cover, while the other end of the contact shaft lies facing the sealing cover, the sealing cover and the facing other end of the contact shaft being provided with cooperating members formed concentric with the axis of rotation of the contact shaft and sliding sealingly telescopically on one another, between which is formed a closed space wherein the mercury is collected, said cooperating members comprise a blind hole formed in the end of the contact shaft and a sealing plug formed on the sealing cover with said plug extending partially into the blind hole in order to close it off.

4. Current collector according to claim 3, wherein the sealing plug carries a concentric contact pin which projects into the mercury.

5. Current collector according to claim 3, wherein the innermost part of the blind hole is designed with a diameter greater than the sealing plug and has an annular shoulder, the sealing plug carrying a bent contact spring, the free end of which projects into the mercury in the annular space between the annular shoulder and the floor of the blind hole.

6. Current collector according to claim 3, wherein the sealing plug in the blind hole forms a split seal for the mercury.

7. In a current collector, provided with a housing, wherein is rotatably supported an electrical contact shaft which, by an end projecting from one end of the housing, may be brought into contact with an independently rotating shaft in order thereby to be brought into a rotation and likewise make electrical contact therewith, where mercury is contained in the housing in order to bring about electrical connection between the contact shaft and a contact member attached in the housing, the improvement wherein the housing is closed off at its other end by a removable sealing cover while the other end of the contact shaft lies facing the sealing cover, the centermost part of the contact shaft is received in two angular contact bearings, the inner races of which are confined between a flange formed on the contact shaft and a retaining nut screwed on the contact shaft and the outer races of which fit on the cylindrical inner surface of the housing and are confined between a shoulder formed on the housing and a sealing cover attached to the housing by means of a retaining ring, the sealing cover and the facing other end of the contact shaft being provided with cooperating members formed concentric with the axis of rotation of the contact shaft and sliding sealingly telescopically on one another, between which is formed a closed space wherein the mercury is collected, said closed space being subject to addition and removal of said mercury upon separation of said sealing cover from said housing.

8. Current collector according to claim 7, wherein the sealing cover consists of metal, while the housing and the retaining ring consist of synthetic material.

9. Current collector according to claim 7, wherein the retaining ring bears an internal dividing wall which is provided with a central aperture through which the contact shaft extends, while about the aperture is mounted, on the dividing wall, a rubber V-seal which seals off the end of the contact shaft projecting through the aperture.

10. Current collector as in any one of claims 7–9 inclusive, in which the end of the contact shaft projecting from the housing projects with clearance through an aperture of a cover attached to the housing, while about the aperture a rubber V-seal is attached to the cover, which seal seals off the end of the contact shaft projecting through the aperture.

11. Current collector according to claim 1, further comprising grease chambers formed between the bearings and the cover, and the bearings and the dividing wall.

12. Current collector according to claim 1, wherein the end of the contact shaft projecting from the housing projects with clearance through an aperture of a cover attached to the housing, while about the aperture a rubber V-seal is attached to the cover, which seals off the end of the contact shaft projecting through the aperture.

13. In a current collector, provided with a housing, wherein is rotatably supported an electrical contact shaft which, by an end projecting from one end of the housing, may be brought into contact with an independently rotating shaft in order thereby to be brought into rotation and likewise make electrical contact therewith, where mercury is contained in the housing in order to bring about electrical connection between the contact shaft and a contact member attached in the housing, the improvement wherein the housing is closed off at its other end by a removable sealing cover, the sealing cover is made of an electrically conducting material and the housing is made of an electrically non-conducting material, the other end of the contact shaft lies facing the sealing cover, the sealing cover and the facing other end of the contact shaft being provided with cooperating members formed concentric with the axis of rotation of the contact shaft and sliding sealingly telescopically on one another, between which is formed a closed space wherein the mercury is collected, said closed space being subject to addition and removal of said mercury upon separation of said sealing cover from said housing.

14. Current collector according to claim 3, wherein the centermost part of the contact shaft is received in two angular contact bearings, the inner races of which are confined between a flange formed on the contact shaft and a retaining nut screwed on the contact shaft, and the outer races of which fit on the cylindrical inner surface of the housing and are confined between a shoulder formed on the housing and a sealing cover attached to the housing by means of retaining ring.

15. Current collector according to claim 14, wherein the retaining ring bears an internal dividing wall which is provided with a central aperture through which the contact shaft extends, while about the aperture is mounted, on the dividing wall, a rubber V-seal which seals off the end of the contact shaft projecting through the aperture.

16. Current collector according to claim 15, wherein the end of the contact shaft projecting from the housing projects with clearance through an aperture of a cover attached to the housing, while about the aperture a rubber V-seal is attached to the cover, which seal seals off the end of the contact shaft projecting through the aperture.

17. Current collector according to claim 16, wherein between the bearings and the cover and the dividing wall are formed grease chambers respectively.

18. Current collector according to claim 3, wherein the sealing cover is made of an electrically conducting material and the housing is made of an electrically non-conducting material.

19. Current collector according to claim 4, wherein the sealing plug in the blind hole forms a split seal for the mercury.

20. Current collector according to claim 5, wherein the sealing plug in the blind hole forms a split seal for the mercury.

* * * * *

UNITED STATES PATENT AND TRADEMARK OFFICE

CERTIFICATE OF CORRECTION

PATENT NO. : 4,566,744

DATED : January 28, 1986

INVENTOR(S) : HENDRIK V. ENGELENBURG

It is certified that error appears in the above-identified patent and that said Letters Patent is hereby corrected as shown below:

Column 1, line 8, after "order" insert --thereby--.

Column 1, line 18, omit "these" and insert --said--.

Column 1, line 35, omit "one" and insert --its other--.

Column 1, line 35, after "while the" insert --other--.

Column 1, line 59, omit "by" and insert --owing to--.

Column 1, line 59, omit "," .

Column 2, line 41, after "having" insert --the form of--.

Column 2, line 54, omit "The" and insert --At the--.

Column 3, line 1, omit "which" and insert --whereon--.

Column 4, line 26, omit "by" and insert --owing to--.

UNITED STATES PATENT AND TRADEMARK OFFICE

CERTIFICATE OF CORRECTION

PATENT NO. : 4,566,744

DATED : January 28, 1986

INVENTOR(S) : HENDRIK V. ENGELENBURG

It is certified that error appears in the above-identified patent and that said Letters Patent is hereby corrected as shown below:

Column 6, line 8, omit "claim 1" and insert --claim 12--.

Column 6, line 12, omit "claim 1" and insert --claim 9--.

Signed and Sealed this

Eighteenth Day of November, 1986

*Attest:*

DONALD J. QUIGG

*Attesting Officer* *Commissioner of Patents and Trademarks*